United States Patent [19]

Chambley et al.

[11] 4,276,740

[45] * Jul. 7, 1981

[54] SELF-TWISTED YARN AND METHOD AND APPARATUS FOR PRODUCING IT

[75] Inventors: Phillip W. Chambley; Alan H. Norris, both of Rome, Ga.

[73] Assignee: WWG Industries, Inc., Rome, Ga.

[ * ] Notice: The portion of the term of this patent subsequent to Feb. 21, 1995, has been disclaimed.

[21] Appl. No.: 12,771

[22] Filed: Feb. 16, 1979

Related U.S. Application Data

[63] Continuation-in-part of Ser. No. 844,616, Oct. 25, 1977, Pat. No. 4,215,642, which is a continuation-in-part of Ser. No. 755,671, Dec. 30, 1976, Pat. No. 4,074,511.

[51] Int. Cl.[3] ..... D01H 5/28; D01H 7/90; D01H 7/92; D02G 3/26

[52] U.S. Cl. ..... 57/205; 57/293; 57/350; 57/204; 57/328

[58] Field of Search ..... 57/204, 205, 293, 294, 57/350, 333, 328

[56] References Cited

U.S. PATENT DOCUMENTS

| | | | |
|---|---|---|---|
| 3,225,533 | 12/1965 | Henshaw | 57/293 |
| 3,434,275 | 3/1969 | Backer et al. | 57/293 X |
| 3,443,370 | 5/1969 | Walls | 57/293 |
| 3,468,120 | 9/1969 | Hildebrand | 57/293 |
| 3,537,251 | 11/1970 | Kimura et al. | 57/293 X |
| 3,717,988 | 2/1973 | Walls | 57/293 |
| 3,775,955 | 12/1973 | Shah | 57/293 |
| 4,074,511 | 2/1978 | Chambley et al. | 57/293 |
| 4,123,893 | 11/1978 | Chambley et al. | 57/204 |

*Primary Examiner*—John Petrakes

*Attorney, Agent, or Firm*—Beveridge, De Grandi, Kline & Lunsford

[57] ABSTRACT

Two or more single strands are formed and false twisted to provide sections of S-twist and Z-twist which are longitudinally spaced apart and separated by nodes which have no twist. The strands while moving longitudinally are held against rotation at points between which the adjacent strands twist in a same direction. The twist between each pair of points becomes redistributed, and the strands are released to enable them to twist together to form a self twist plural strand yarn.

The strands are held against rotation during twist redistribution by apparatus which includes a device for interconnecting the strands at the points, and a rotation preventer which moves with and lies between the strands adjacent to the interconnected points.

13 Claims, 6 Drawing Figures

SELF-TWISTED YARN AND METHOD AND APPARATUS FOR PRODUCING IT

REFERENCE TO RELATED APPLICATIONS

This is a continuation-in-part of our pending U.S. patent application Ser. No. 844,616 filed Oct. 25, 1977, now U.S. Pat. No. 4,215,642, which is a continuation-in-part of our earlier U.S. Patent application Ser. No. 755,671 filed Dec. 30, 1976, now U.S. Pat. No. 4,074,511. The disclosures of these earlier applications are incorporated herein by reference.

BACKGROUND OF THE INVENTION

This invention relates to self-twist yarn and an improved process and apparatus for forming it.

In the manufacture of yarn, particularly from synthetic fibers, there have been substantial developments in the areas of false-twist and self-twist yarns because of various production advantages which can be realized using these techniques. Such processes provide a shortened manufacturing route to a finished yarn product, and are therefore more economical as compared with conventional spinning and twisting processes.

As used herein, the term "false-twist" refers to a yarn in which a yarn strand is twisted by a twist insertion device to generate opposite twists on either side of the device. The point in the strand where the twist reverses has zero twist and will be referred to as a "node." The directions of twist are referred to as "S-twist" or "Z-twist," the appropriate letter being employed for twists in which the helices are twisted strands correspond with the middle portion of the appropriate letter.

The term "self-twist" is applied to yarns wherein two or more false twisted strands are brought together and permitted to ply themselves. The approximately equal torsional force of the same direction is stored in two or more singles yarns which are later brought into contact. Torque is released, permitting the single yarns to untwist, and in so doing, wrap around each other to form a plied yarn.

Generally speaking, false-twisting and self-twisting and the yarns produced thereby have received considerable attention in recent years. Our U.S. Pat. Nos. 4,074,511, 4,104,855 and 4,123,893 relate to this subject, and disclose but do not claim the invention claimed herein. Reference is also made to the following documents which describe these yarns, the techniques for producing them, and specific apparatus related thereto:

"Self-Twist Yarn", D. E. Henshaw, Merrow Publishing Co. Ltd., Watford, Herts, England, 1971.

| | |
|---|---|
| RE 27,717 | Breen et al |
| 3,225,533 | Henshaw |
| 3,306,023 | Henshaw et al |
| 3,353,344 | Clendening, Jr. |
| 3,434,275 | Backer et al |
| 3,488,939 | Walls |
| 3,507,108 | Yoshimura et al |
| 3,537,251 | Kimura et al |
| 3,717,988 | Walls |
| 3,775,955 | Shah |
| 3,940,917 | Strachan |
| 4,055,039 | Movshovich et al |
| 4,068,459 | Movshovich et al |
| 4,084,400 | Movshovich et al. |

While this is by no means an exhaustive listing of patents or literature references on this subject, these references provide a foundation for the principles and techniques of this invention.

As will be recognized from these and other references relating to this art, there are a number of problems inherent in producing yarn using self-twist techniques, these problems being related in part to the fact that the yarn tends to be relatively unstable due to the different twists in singles being able to cancel each other through the node area. In this regard, the above-cited U.S. Pat. No. 3,434,275, to Backer et al suggests joining regions of twist reversal. Also, in the production of self-twist yarn, the yarn tension and other parameters involved in the production are highly critical and must be closely controlled.

When a continuously moving pair of single strands are twisted, brought together and allowed to ply immediately, the plied yarn has been found to exhibit non-uniform twist distribution. Generally, the twist is tighter just after the twist direction change at the node, and then begins to decrease with increased distance from the node. In some cases, a distinct loss of twist has been observed just prior to the direction change node.

The tight twist presence preceding the node can be attributed to feed-through of backed up twist from behind the insertion device when the twist direction change occurs. Because the ply twist is the result of the release of forces stored in the singles twist, the twist non-uniformity in the plied yarn is apparently caused by non-uniformity of the singles twist. This is partly the result of twisting the singles yarn while it moves through a reversible twist insertion device such as a reversible jet twister. The strand is twisted in one direction, generating, for example, a Z twist behind the jet and an S twist ahead of the jet, and then reversing the direction of the twist insertion device so that, at the instant of the switch from Z to S ply mode, the jet permits the leading end of the upstream Z singles twist to pass through to a position downstream of the jet. After reversal, the jet further inserts Z twist ahead of the jet in a portion of the yarn which already has some Z twist, thereby causing the portion adjacent the node to be more tightly twisted than the following portions. This is also true when the twist is in the opposite direction.

Clearly, such uneven twist creates differences in stored torque along the length of twist between the nodes. The yarn cross-sectional areas (fibers per cross-section) are equal or nearly equal. Since one portion is twisted tighter than other portions, it has greater stored torque and therefore a greater tendency to untwist than the other portions.

It will be observed that the yarn twist cannot be redistributed after plying because each cross-section in a self-twist yarn has reached a torque balance between the ply and singles twist. Once this balance occurs, no further axial rotation can occur.

This invention provides a solution to some of the production speed and quality control problems which have been experienced in the prior art. The invention provides for an uncomplicated machine and process operable at relatively high speeds to produce a quality yarn. The coincidence between production speed and yarn quality is attributable in large part to the fact that after the single strands are twisted, their twist is permitted to level or redistribute itself before the strands are set free to ply about each other.

SUMMARY OF THE INVENTION

The method and apparatus of this invention are capable of high speed production of a yarn which has a desirable degree of twist uniformity.

According to the method, two single strands are formed and twisted individually during longitudinal movement to provide them with longitudinally spaced sections of S-twist and Z-twist separated by nodes at which the direction of twist reverses. As the twisted strands move longitudinally, their rotation is prevented at points between which the adjacent strands twist in a same direction. This rotation prevention permits the twist between the points to become redistributed, after which the strands are released, permitting them to twist together and form a self-twist plural strand yarn.

The inventive method preferably prevents strand rotation by forming strand connections which interconnect the strands at the above-mentioned spaced points. The strand connections prevent relative rotation of the strands about their own axes at the strand connections. The strands are engaged with a rotation preventer which prevents rotation of the strand connections and moves longitudinally with the strands adjacent to the strand connections. The twist in the strands are redistributed at least to some degree, and the strands are released from the rotation preventer to permit them to twist together.

The yarn of the invention is a yarn produced by the process described in either of the preceding paragraphs. The apparatus of the invention includes means for performing the steps described in the two preceding paragraphs. Preferably, the apparatus also includes a rotary guide wheel which guides the strands, carries the rotation preventer and carries the joining means for forming the strand connections.

DESCRIPTION OF THE DRAWINGS

In order that the manner in which the foregoing and other objects are attained in accordance with the invention can be understood in detail, particularly advantageous embodiments thereof will be described with reference to the accompanying drawings, which form a part of this specification, and wherein.

DESCRIPTION OF THE PREFERRED EMBODIMENTS

Figure 1:
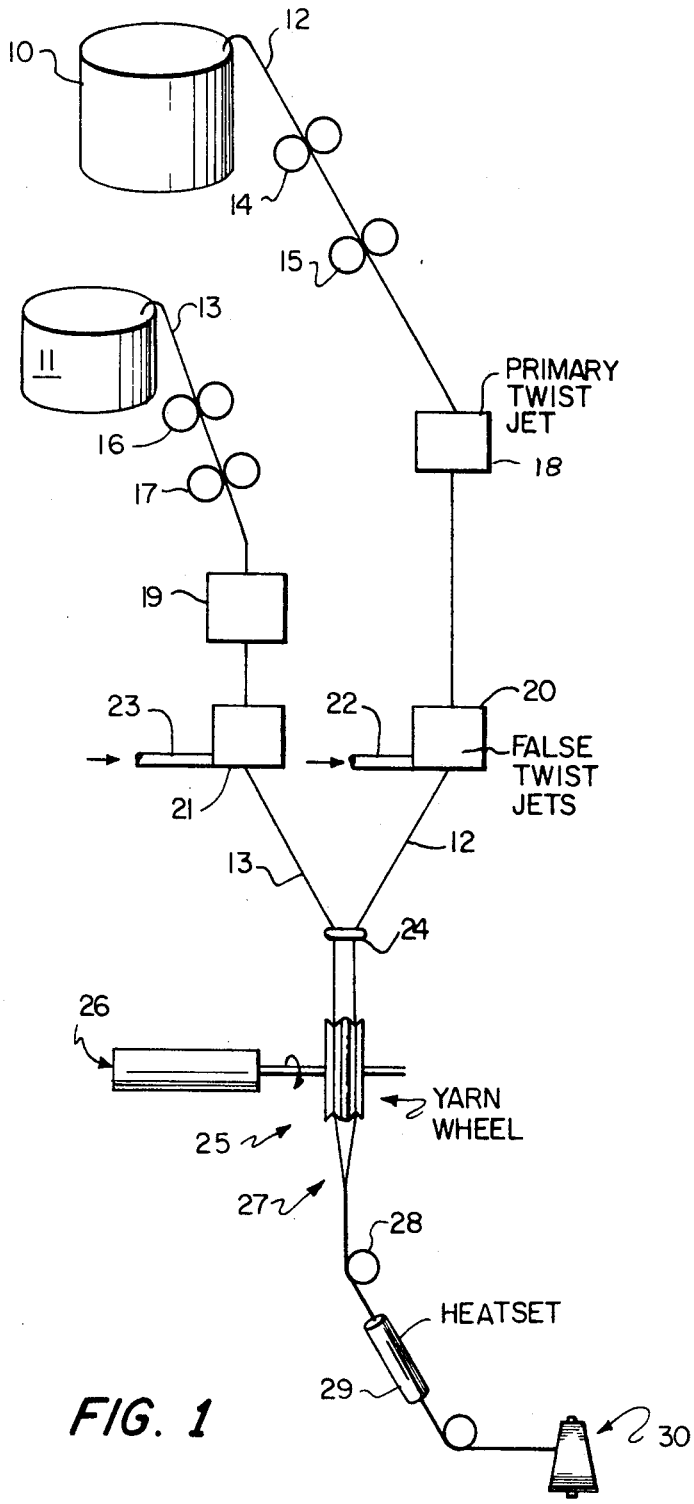
FIG. 1 is a schematic diagram of a system for forming self-twisted yarns employing apparatus according to the present invention.

As shown in FIG. 1, the system will be described commencing with the yarn strands being withdrawn from sliver containers 10 and 11, the yarn strands 12 and 13 being subjected to a drafting or drawing process by pulling the yarns between drafting rolls, yarn 12 being drawn by drafting rolls 14 and 15 and yarn 13 being drawn by rolls 16 and 17. Roll 15 typically is driven at a surface velocity greater than that of roll 14, and roll 17 is driven at a surface velocity greater than roll 16. The yarns can then be passed through primary twist jets, yarn 12 being passed through primary twist jet 18 and yarn 13 being drawn through primary twist jet 19. The primary twist jets operate to impart and maintain twist at the critical point where the otherwise flat sliver ribbon leaves the draft delivery rolls. Yarn strand 12 is passed through a singles-twist jet 20 and yarn 19 is passed through a singles-twist jet 21 wherein the twist is inserted in the yarn strands. Air pressure under the control of apparatus not shown is supplied to jets 20 and 21 through conduits 22 and 23, respectively.

Such control apparatus may be fluidic valves, electrical valves or mechanically operated valves, such apparatus being conventionally available. An example thereof is to be found at page 30 of the previously cited Henshaw text, "Self Twist Yarn," in FIG. 3.8(*b*). It should be noted at this stage that jets 20 and 21 are paired to twist the yarn strands in the same direction as each other and are operated to reverse periodically the direction of twist to result in a yarn wherein there are opposite senses of twist separated by short nodes of zero twist, which nodes are in synchronization with the yarn wheel which bears the fixation device, so that the nodes appear at the surface of the fixation disc. Thus, yarn strands 12 and 13 emerge from jets 20 and 21 with alternating S and Z portions of twist therein.

The strands are passed through opposite sides of a generally elongated wire guide 24 which assists in maintaining the singles twist in the yarn strands and serves the purpose of bringing the yarns into a relatively closely spaced relationship, preferably not in contact with each other. The yarns are guided onto a yarn wheel indicated generally at 25, the details of which will be described hereinafter. Yarn wheel 25 serves the functions of guiding the strands in parallel spaced relationship with each other, connecting the strands together at spaced points between which the strands are twisted in the same direction, and preventing the connected points from rotating until the twist in the individual strands has redistributed itself longitudinally.

The yarn wheel 25 is driven by a drive and control device indicated generally at 26 in synchronism with the delivery speed of the yarn and the control apparatus controlling jets 20 and 21 so that the nodes are contacted by the fixation disc on the yarn wheel.

After the spaced connections are made between the strands, the strands are held to prevent them from plying together. This permits the twist between the connections to redistribute itself more evenly. The strands are released to rotate and ply together. The plied yarn is guided around a doffer roll 28 and wound or taken up by other appropriate means, or may be first passed through the continuous heat-setting apparatus indicated schematically at 29 prior to take up. Doffer roll 28 may be, for example, a turned metal wheel with a knurled or emery surface, so that it assures removal of the plied yarn from contact with the fixation device. Finally, the yarn can then be stored for future use as indicated at 30.

Figure 2:
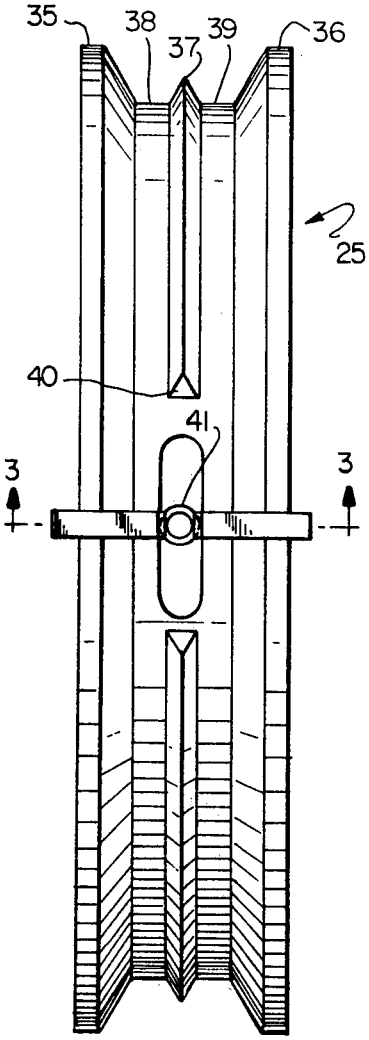
FIG. 2 is a front elevation of a yarn wheel including guide means and node fixation means in accordance with the present invention.

A first embodiment of a yarn wheel including rotation-preventing means and strand joining means for forming the spaced strand connections is indicated generally at 25 in FIG. 2. As shown therein, the wheel may be a generally disc-shaped member having flanges 35 and 36 at the axial limits thereof and a central, separatory flange 37, the three flanges defining peripheral surface portions 38 and 39 along which yarn strands can be separately guided. Although wheel 25 is shown as having a single central, separatory flange 37, additional separatory flanges may be provided depending on the number of singles yarns being plied. The number of separatory flanges will always be one less than the number of singles yarns being plied. Central flange 37 is interrupted at 40 to permit the strands to come into close proximity with each other and also to come in contact with the contacting surface of the strand joiner, e.g., an abrasion disc 41 which is rotating about an axis generally perpendicular both to the yarn and to the axis of rotation of the yarn wheel at a relatively high speed, on the order of 8,000 rpm. Typically, the disc can be driven by an electric motor which is mounted in the yarn wheel and to which D.C. voltage is supplied by means of a brush and slip ring combination which will be described with reference to FIG. 5. Regardless of the number of separatory flanges 37 utilized, each single strand must be brought into contact with every other singles strand on the disc 41 by suitable channeling means.

The rapidly rotating contact surface may vary in texture depending upon the nature of the particular yarn being fastened. Thus, such surface may be relatively coarse, e.g., 30 to 100 grit, or may be relatively smooth, e.g., hard rubber or polyurethane, which surface may be treated with a material in order to increase the frictional properties of the contact surface. Additionally, the contact surface may be composed of closely spaced wire pins or bristles. In general, any form of contact surface may be used which, when rotated, serves to fasten the nodes by locking the yarn fibers of adjacent nodes together when brought into contact therewith.

Figure 3:
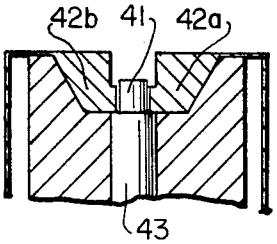
FIG. 3 is a section along lines 3—3 of FIG. 2.

As shown in FIG. 3, the guides 42*a* and 42*b* serve as a channeling means for deposit of the strands directly on the surface of the fixation disc 41 and also serve to maintain the strand on the disc long enough to connect them together at spaced points. The disc can be driven by an electrical motor 43. Although FIG. 2 illustrates a wheel 25 having a single rotating fixation means 41, it is preferred that the wheel may be provided with a plurality of joining means distributed around the wheel.

Figure 4:
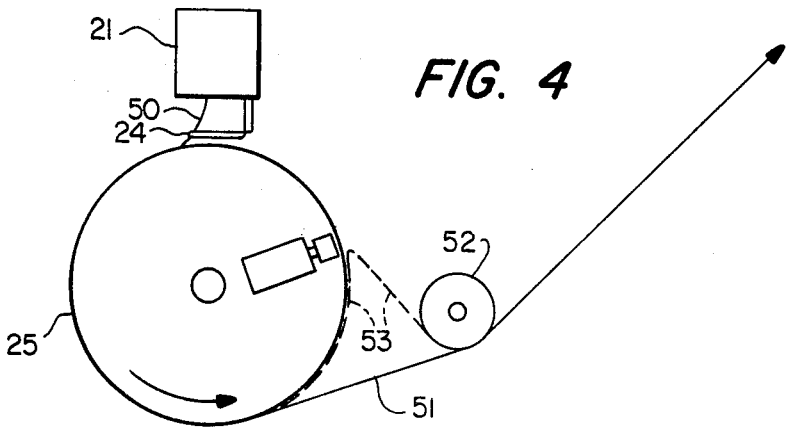
FIG. 4 is a side elevation schematically illustrating the yarn wheel of FIGS. 2 and 3 and related guide means.

FIG. 4 shows a side elevation of a yarn wheel, such as the wheel 25 of FIGS. 2 and 3 with a jet such as jet 21 and wire guide 24 to guide the yarn onto the wheel. A twisted portion 50 of the yarn strand emerges from the jet 21, and is received on and guided by the yarn wheel 25. The fixation means 41 forms strand connections which interconnect the single strands at points between which both strands twist in a same direction. The strand connections prevent the connected points from rotating about their own axes. The separatory flange 37, being located adjacent to, ahead of and behind the fixation means and the strand connection formed thereby, prevents rotation of the strand connections and consequently prevents plying of the individual strands. The strands, being restrained from plying together are able to self-adjust any variations in torque between nodes by slippage on the wheel surface in the direction of rotation about their own axes, thereby equalizing the twist distribution. After at least some redistribution of twist has occurred, the strands are withdrawn from the wheel 25, pass beyond the rotation-preventing separatory flange, and ply together by self-twisting. The yarn follows the path indicated at 51 around a guide wheel 52 which is referred to as a doffer roll. The yarn passes around only a portion of the doffer roll, normally, and proceeds either to the heat set apparatus and/or to apparatus for winding onto a storage package.

It is possible, however, for the yarn to become engaged on the fixation disc 41 and follow a path indicated generally at 53 by broken lines, this being an undesirable event because it introduces additional tension into the yarn and can cause breakage. For this reason, it is desirable to provide the doffer roll to assure that the yarn follows the normal, desired path and does not become stuck on the yarn wheel.

Figure 5:
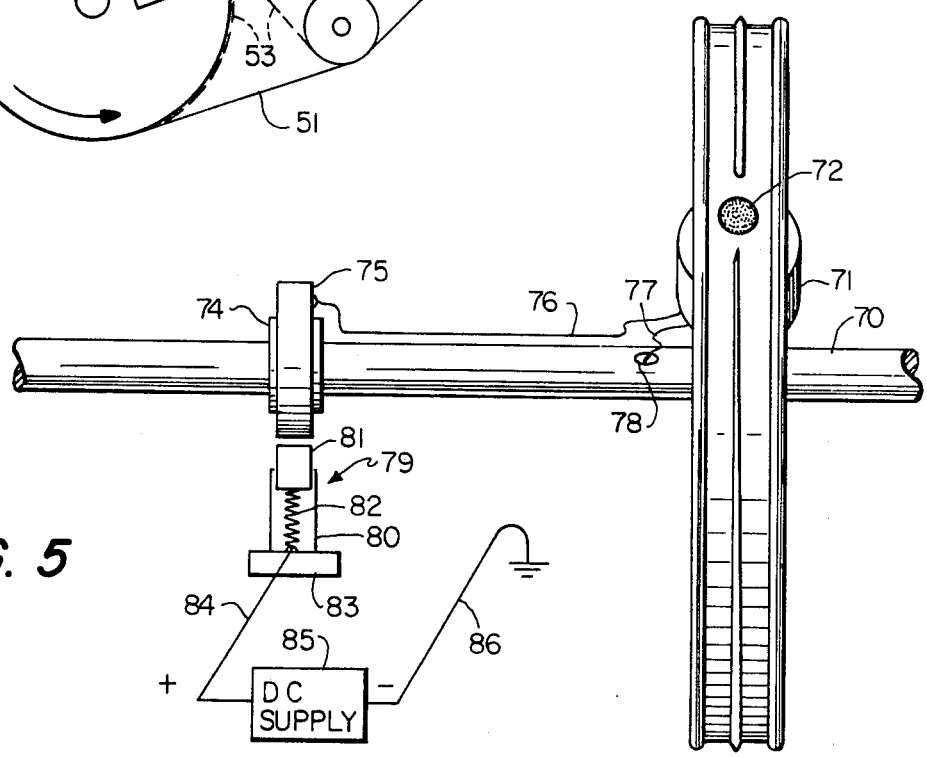
FIG. 5 is a schematic side elevation of a yarn wheel in accordance with the invention showing an arrangement of slip rings.

A suitable arrangement for providing power to a motor for driving the fixation disc is shown in FIG. 5. The yarn wheel 25 is fixedly mounted on a yarn wheel drive shaft 70 so that the wheel rotates with the shaft. A fixation disc drive motor 71 is mounted in wheel 25 so that its axis of rotation and its output shaft extend along a radius of wheel 25. An abrasion disc 72 is mounted on the distal end of the shaft of motor 71 so that energization of motor 71 causes disc 72 to rotate. While motor 71 can be an AC motor, a DC motor is preferred because the speed of the motor can then be made variable in a simple fashion by varying the magnitude of the DC supply.

Also, fixedly mounted on shaft 70 is an electrically nonconductive insulator bushing 74. An electrically conductive ring 75 is mounted on bushing 74 so that a conductive outer surface thereof is exposed. Ring 75 is electrically connected to one terminal of motor 71 by a wire 76, the other terminal of motor 71 being grounded by a wire 77 connected between the terminal and a convenient point on the frame of the apparatus such as a screw 78 on shaft 70.

A brush holder indicated generally at 79 is mounted on the machine frame adjacent ring 75, the brush holder being conventional in nature and having a sleeve 80 within which a standard carbon brush or the like 81 is movable toward and away from the exposed conductive surface of ring 75. The brush 81 is urged toward ring 75 by a compression coil spring 82 which extends between brush 81 and a mounting base plate 83 on which sleeve 80 is mounted. A wire 84 is connected between brush 81 and one terminal of a source of DC voltage 85, the other terminal of source 85 being connected to ground as by a wire 86.

With this arrangement, ring 75 acts as a slip ring, brush 81 being in continuous electrical contact therewith to supply energizing power to motor 71. Source 85 can include conventional switching and control means to vary the magnitude of the voltage supplied.

Figure 6:
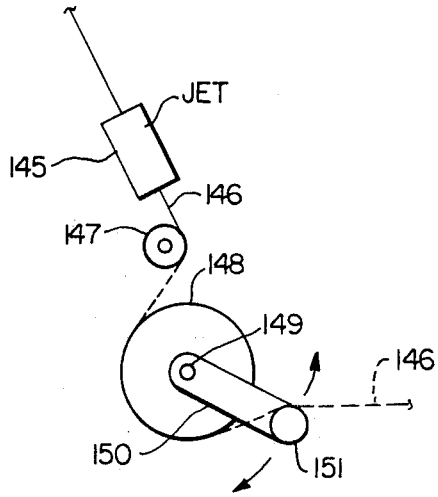
FIG. 6 is a side elevation, in schematic form, of a yarn wheel and doffing mechanism in accordance with the invention.

In any of the foregoing embodiments, the path of the yarn wheel can be made adjustable, particularly in connection with an embodiment in the nature of FIG. 4 by providing an adjustable doff roller. As illustrated schematically in FIG. 6, twist is inserted in the single yarns by a jet 145, the yarn 146 passing around a runner bowl or guiding means 147 and onto a yarn wheel 148 which is rotatable about a central axis 149. A lever arm 150 is also rotatably mounted on axle 149, the other end of the arm having an axle which supports a doffing roller 151. Thus, the yarn 146 is guided onto the yarn wheel, extends partially around the wheel, and then separates from the wheel and passes around doffing roller 151. As indicated in FIG. 6, the extent of travel of the yarn on the yarn wheel and therefore the time that the node is treated by the fixation device is adjustable by adjusting the angle of arm 150 about axis 149.

Persons familiar with yarn processing will recognize that the invention may be practiced in many ways other than the preferred disclosed embodiments. For example, the twists of the adjacent single yarns may be slightly phase shifted in a known manner to avoid node alignment, and the strand connections may be made at the nodes or elsewhere by fusion, adhesion, cohesion or fluidic or mechanical contact entanglement means known in the art. Since the invention is susceptible to many modifications and may take many forms, it it emphasized that it is not limited to the specific embodiment described herein but embraces a variety of forms which fall within the spirit of the following claims.

We claim:

1. Apparatus for forming a self-twist plural strand yarn from at least two single strands, comprising, means for moving each of said single strands longitudinally, means for twisting said single strands individually during their longitudinal movement to form twisted single strands each having longitudinally spaced sections of S-twist and Z-twist separated by nodes at which the direction of twist reverses, joining means for connecting said twisted single strands to each other at longitudinally spaced strand connections between which both strands twist in a same direction, the strand connections preventing relative rotation of said strands about their own axes at the strand connections, and a longitudinally movable rotation preventer located adjacent to said strand connections to prevent rotation of said strand connections, said rotation preventer being movable with the strands to permit the twist in the moving twisted single strands to become redistributed between each pair of strand connections, means for separating the strands from the rotation preventer after the twists are redistributed to permit the strand connections to rotate and enable the strands to twist together to form a self-twist plural strand yarn.

2. The apparatus of claim 1 wherein the twisting means are reversible fluid jet twisters.

3. The apparatus of claim 1 wherein said rotation preventer includes separatory means located between said single strands.

4. The apparatus of claim 3 wherein said separatory means lie ahead of and behind each of said strand connections.

5. The apparatus of claim 4 including a rotary guide wheel which receives and guides the single strands, said separatory means and said joining means being located on and rotatable with the guide wheel.

6. A method of forming a self-twist plural strand yarn from at least two single strands, comprising the steps of, moving each of said single strands longitudinally, twisting said single strands individually during their longitudinal movement to form twisted single strands each having longitudinally spaced sections of S-twist and Z-twist separated by nodes at which the direction of twist reverses, preventing rotation of said strands during their longitudinal movement at points which move longitudinally with the strands and between which both strands twist in a same direction, permitting the twist in the strands to become redistributed longitudinally between each pair of points, and releasing the strands after the twists are redistributed to permit the strands to rotate together at said points and twist together to form a self-twist plural strand yarn.

7. The method of claim 6 wherein the twisting step is performed by passing the strands through twisters which periodically reverse the direction of twist.

8. A yarn produced by the method of claim 7.

9. The method of claim 6 wherein the step of preventing rotation of the strands at said points is performed by first connecting said twisted singles strands to each other at said points to provide longitudinally spaced strand connections at which relative rotation of the strands about their own axes is prevented, and preventing rotation of the strand connections with a rotation preventer which moves longitudinally with the strands adjacent to the strand connections, said step of releasing the strands being performed by separating the strands from the rotation preventer.

10. The method of claim 9 wherein the step of preventing rotation of the strand connections is performed by holding the rotation preventer between the strands adjacent to the strand connections.

11. The method of claim 9 wherein the rotation preventer is inserted between said moving strands adjacent to said strand connections, both ahead of and behind said strand connections.

12. A yarn produced by the method of claim 9.

13. A yarn produced by the method of claim 6.

* * * * *